US006275565B1

(12) United States Patent
Tomie

(10) Patent No.: US 6,275,565 B1
(45) Date of Patent: Aug. 14, 2001

(54) LASER PLASMA LIGHT SOURCE AND METHOD OF GENERATING RADIATION USING THE SAME

(75) Inventor: Toshihisa Tomie, Tsukuba (JP)

(73) Assignee: Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/700,720

(22) PCT Filed: Mar. 31, 1999

(86) PCT No.: PCT/JP99/01690

§ 371 Date: Nov. 28, 2000

§ 102(e) Date: Nov. 28, 2000

(87) PCT Pub. No.: WO00/60909

PCT Pub. Date: Oct. 12, 2000

(51) Int. Cl.[7] ..... H05G 2/00
(52) U.S. Cl. ..... 378/119; 378/122
(58) Field of Search ..... 378/34, 119, 120, 378/121, 122; 372/5

(56) References Cited

U.S. PATENT DOCUMENTS 4,058,486 * 11/1977 Mallozzi et al. ..... 375/5
4,700,371 * 10/1987 Forsyth et al. ..... 378/34
4,704,718 * 11/1987 Suckewer ..... 372/5
6,038,279 * 3/2000 Miyake et al. ..... 378/34

FOREIGN PATENT DOCUMENTS 1-143385 * 6/1989 (JP) .
5-119199 * 5/1993 (JP) .
6-77157 * 3/1994 (JP) .

* cited by examiner

*Primary Examiner*—David P. Porta
(74) *Attorney, Agent, or Firm*—Oblon, Spivak, McClelland, Maier & Neustadt, P.C.

(57) ABSTRACT

A solid target (11) is formed with a cavity (12). The inner wall of the solid target at the cavity is ablated by ablation pulsed laser beams (13). The solid target is left standing until a highly densified portion (15) of a vaporized substance (14) is formed in the space within the cavity (14), and the highly densified portion (15) is then irradiated with heating pulsed laser beams (17), thereby forming high-temperature plasma (18) for generating radiation rays (19). As a result, good-quality radiation rays accompanied by a minimal amount of debris can be generated.

14 Claims, 2 Drawing Sheets

LASER PLASMA LIGHT SOURCE AND METHOD OF GENERATING RADIATION USING THE SAME

BACKGROUND OF THE INVENTION

1. Field of the Invention

The present invention relates to a laser plasma light source adapted to provide a light source powerful in an extremely short wavelength region particularly extending from the extreme ultraviolet region over the X-raywavelength region and to a method for generating radiation rays using the light source.

2. Discussion of the Background

As a small-sized light source having high brightness in the extreme ultraviolet region and X-ray region required in various fields including X-ray spectroscopy and X-ray measurement, laser plasma light sources that generate radiation rays by irradiating solid matter with pulsed laser beams have been used advantageously. However, laser plasma light sources pose a serious problem. It is a fact that a laser-plasma generates a large quantity of debris (scattered solid matter). In some cases, an optical element for collecting extreme ultraviolet rays or X-rays over a wide range of angles, such as a reflecting mirror, is used in order to effectively utilize a plasma light source that is a scattering light source. The optical element used in this case is prone to damage and contamination in the presence of debris.

Such laser plasma light sources are nevertheless attracting attention in the development of X-ray reduction lithography, which promises to become the lithography of the next century. In order to enable practical application to this technology, however, extremely strict suppression of debris generation has to be ensured so that the decrease in reflectance of a multilayer reflecting mirror can be reduced to not more than several percent even after a continuous operation of not less than 109 shots. To be specific, when the pulse energy of laser beams is 1 J and the efficiency of conversion into X-rays is 1%, the total quantity of debris attached to an optical surface is required to be not more than about 109 pg/sr/shot Various attempts have been made to suppress debris. For example, the inventor et al. carried out quantitative evaluation of debris [T. Tomie et al., Proc. SPIE 831 (1987) 224]. In addition, it has been reported that the quantity of debris reaching a position 10 cm from the plasma was reduced by approximately two orders in an experiment conducted for generating a plasma in a He gas. Furthermore, it was also reported that the quantity of debris can be reduced by making a solid target thinner. However, the quantity of debris after reduction by these means was larger by several orders than that strictly required in reduction lithography.

On the other hand, Mochizuki et al. proposed the idea of using a cryo-target made of a rare gas, such as Xe, solidified, that could avoid the problem of the quantity of debris because deposition probability of rare gases to optical surfaces would be low [Mochizuki et al., Proc. SPIE 773 (1987) 246]. G. D. Kubiak et al. experimented on this idea at the Sandia National Laboratory, California, U.S.A. and developed a system of pellezing a solidified rare gas and impelling the pellets into a position to be irradiated with pulsed laser beams [G. D. Kubiak et al., Tech. Digest Extreme Ultraviolet Lithography (Monterey, 1994 Sep.) Tu D1 pp. 82–84].

In addition, a liquid drop target was proposed in Lund University at the City of Lund, Sweden as means for solving the engineering problem of continuous supply of targets in the rare gas pellet system. An alcohol was jetted out of a high-speed vibrating nozzle to produce alcohol drops 10 $\mu$m in diameter at 1 MHz repetition ratet. When these drops were irradiated with laser beams having a pulse width of 70 ps, pulse energy of 70 mJ and a wavelength of 0.5 $\mu$m, the efficiency of conversion into X-rays having a wavelength of 3 nm was around 1%. An experiment was conducted for generating long-wavelength X-rays required in reduction lithography, using laser beams having a pulse width of 8 ns, pulse energy of 700 mJ and a wavelength of 1 $\mu$m, and the efficiency of conversion into X-rays having a wavelength of 13 nm was around 0.1% [L. Mahnqvist et al., OSA TOPS on Extreme Ultraviolet Lithography, 1996, Vol. 4, eds. G. D. Kubiak and D. R. Kania (Opt. Soc. Am., Washington, D.C., 1996) pp. 72–74]. The total quantity of debris was estimated to be 6 pg/sr/pulse from the quantity of the debris attached to a glass plate disposed in the vicinity of the target [L. Rymell and H. M. Hertz, Rev. Sci. Instrum. 66 (1995) 4916]. However, since alcohol drops are composed of oxygen and carbon that have a high conversion efficiency in a wavelength region of 2 to 3 nm and are elements not effective for generating X-rays in any other wavelength region.

A system of jetting Xe gas from a jet nozzle was developed at the Sandia National Laboratory and reported [G. D. Kubiak et al., OSA TOPS on Extreme Ultraviolet Lithography, 1996, Vol. 4, eds. G. D. Kubiak and D. R. Kania (Opt. Soc. Am., Washington, D. C., 1996) pp. 66–71]. This report indicates that the ratio of the rare gas attached to and deposited on the optical surface is extremely low, that the substances attached to a multilayer are only the materials for the jet nozzle and its cooling yoke, and that the quantity of the rare gas attached to the optical surface is as small as 17 pg/shot.

According to the liquid drop system and the gas jetting system mentioned above, the total quantity of debris estimated from the quantity of the debris attached to the optical surface can be reduced by three orders in comparison with the system using a solid target, whereas the efficiency of conversion of x-rays is merely one half, i.e. 0.5%, that obtained with a solid target of gold. The conversion efficiency is desired to be around several times from the standpoints of realization of a practical system and lightening the burden of excitation laser beams.

Depending on what the light sources of this lind are used for, radiation rays with various wavelengths have to be generated. On the other hand, since the wavelength peak and bandwidth of X-rays generated from a plasma vary depending on the elements, various elements are to be converted to a plasma. In the gas jetting system, however, the materials used are limited to Xe, Ar, $N_2$and the like. The wavelength of the X-rays from the Xe gas jetting light source used at the Sandia National Laboratory has been found to be 11.5 nm, deviating from the 13 mn at which a Mo/Si multilayer easiest to fabricate is utilizable. Therefore, development of a novel multilayer utilizable at that X-ray wavelength is urgently needed. In the liquid drop system used at Lund University, the elements used are limited to oxygen, carbon, nitrogen and the like.

Further, in reduction lithography, one of the main issues is how to make the wave front aberration in an optical system small, and it is considered that adoption of a ring field illumination using a region of small wave front aberration is indispensable. For the ring field illumination, a method of arcuately sweeping the position of an X-ray source at high speed using the deflection of laser beams is used advantageously. In the gas jetting system or liquid drop system, however, high-speed sweeping ofthejetting position is simultaneously required. This is not easy.

According to the liquid drop system or gas jetting system, the quantity of debris attaching to an optical surface can be greatly reduced, whereas the amount of liquid to be removed or gas to be vaporized and removed increases. In the liquid drop system, assuming that irradiation can be operated at 1 KHz, only 0.1% of a drop train produced at 1 MHz repetition rate can be utilized. For this reason, it will be necessary to adopt some means for recovering the liquid drops without their being vaporized in order to lighten the burden of the discharge system. In the rare gas jetting system, the time duration of jetting gas from a nozzle required for producing a jetting region of hundreds of $\mu$m is 1 $\mu$s at most while the shutter speed of an ordinary plasma electromagnetic valve is not less than 100 $\mu$s. This means that the amount of gas jetted is excessive by not less than 100 times that required. Therefore, the rare gas jetting system poses a gas-evacuation speed problem, rather than the debris-generating problem, and can be consequently regarded as a system that cannot solve any substantial problem. The various methods proposed heretofore are excellent only from the aspect of suppression of the debris quantity estimated from the quantity of the debris attached to an optical surface, but are dissatisfactory when totally considering the aspects of conversion efficiency, wavelength variability, X-ray source position sweeping property and other significant factors and cannot be put to practical use.

SUMMARY OF THE INVENTION

In view of the above, the inventor has reconsidered the solid target. A solid target system, contrary to the rare-gas, liquid-drop and gas-jetting systems, has a wide range of choice in terms of material elements. For this reason, a material element optimal to generation of X-rays of various wavelengths can be selected. Further, it is possible to sweep the position of the X-ray source at high speed by high-speed deflection of laser beams. Therefore, the solid target system can produce a satisfactory radiation ray source if the generation of a large quantity of debris, its primary defect, can be suppressed. The inventor has pursued this point.

In the course of his studies, he has known the fact that the conventional plasma light source using solid matter as a target has, in addition to a high-temperature plasma portion that generates radiation rays with a short wavelength, such as extreme ultraviolet rays and X-rays, a relatively low temperature, ultra-high density region that does not generate such radiation rays. This low-temperature ultra-high density region stores energy deposited by laser beams at a given ratio while its temperature is not so high as to generate radiation rays, and therefore constitutes a heat source for successively generating debris after the cease of laser heating. If a high-temperature plasma can be generated without producing such a low-temperature ultra-high density region, the quantity of debris should be reduced and the plasma heating efficiency should be improved. The inventor has also found the fact that the energy imparted to plasma is converted into a plasma fluid motion at a considerable ratio. If the plasma can be heated without being accelerated, therefore, the efficiency of conversion into radiation rays can be improved to a great extent.

The present invention has been accomplished on the basis of this knowledge, and the plasma heating process suppressing the generation of an undesirable low-temperature ultra-high density region and suppressing the plasma acceleration is divided into an ablation process for stripping a plasma generating mass off solid matter and a heating process for converting the mass into a high-density plasma, thereby suppressing the generation of debris while using a solid target, and realizing a laser plasma light source with a high conversion efficiency.

Disclosure of the Invention:

The present invention provides a solid target formed with a cavity, an ablation laser source for projecting ablation laser beams toward the cavity to vaporize a surface layer substance of the inner wall of the solid target formed with the cavity and form a highly densified portion of the vaporized substance at a specific region within the cavity, and a heating laser source for projecting heating laser beams onto the highly densified portion to form a high-temperature plasma. This basic configuration can be applied to the following method of generating extremely effective radiation rays. To be specific, the cavity is irradiated with ablation laser beams, preferably pulsed laser beams, to ablate the surface layer of the inner wall of the solid target provided with the cavity. As a result, the stripped-off, expanded, vaporized substance is compressed toward a specific region within the space of the cavity owing to the concave structure of the cavity. The vaporized substance thus separated from the inner wall of the solid target formed with the cavity and compressed in the space within the cavity is then irradiated with heating laser beams, preferably pulsed laser beams, to convert the substance into a high-temperature plasma and generate radiation rays. For the purpose of making the light source characteristics optimum, the laser beams for stripping-off (ablation) and those for heating are generally set to have different wavelengths, different pulse widths and different irradiation intensities. It is preferable that the time of irradiation with the laser beams for heating be made later than the time of irradiation with the laser beams for stripping-off.

The present invention further provides a configuration wherein a through hole communicating with the cavity is formed in the wall of the solid target at the bottom of the cavity in conformity with its center or out of center, whereby radiation rays passed through the through hole are utilized.

The present invention further provides a configuration wherein a solid target is formed with a plurality of cavities arranged along a circular arc on a plane or other planar shape to be individually irradiated with laser beams using high-speed sweeping deflection, whereby ring field illumination or the like illumination is enabled.

In the present invention, the substance generated from plasma is not only removed as an unnecessary substance, but also utilized effectively. That is to say, in converging radiation rays generated by a light source of this kind, a multilayer reflecting mirror comprising a multilayer structure of different kinds of metals or semiconductors is sometimes used. The present invention therefore also encompasses the concept of debris generated being used as a material for depositing layers and forming a multilayer on a suitable support substrate. Therefore, a configuration using a plurality of solid targets of different materials can also be provided. While the particles emitted from plasma are deposited on a multilayer, these have a sputtering function to strike off the multilayer depending on the particle-flying velocity. This sputtering function can also be utilized.

DESCRIPTION OF THE PREFERRED EMBODIMENTS

Figure 1A:
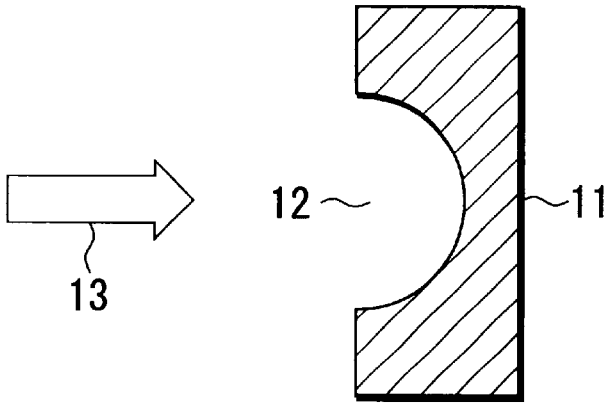
FIG. 1 is an explanatory view showing one embodiment of a method for generating radiation rays using a laser plasma light source, FIG. 1(A) being an explanatory view showing the state of irradiating a solid target with laser beams, FIG. 1(B) being an explanatory view showing the state of vaporizing the surface layer of the target, and FIG. 1(C) being an explanatory view showing the state of irradiating the portion vaporized from the target with pulsed laser beams.

One embodiment of the present invention is shown in FIG. 1. In accordance with the present invention, a cavity 12 having a suitable geometric shape, a hemisphere in this embodiment, is formed in a solid target 11. As shown schematically in FIG. 1(A), laser beams 13 for ablation are projected from an existing suitable ablation laser source (not shown) toward the cavity 12 of the solid target 11 to vaporize only the surface-layer portion of the inner wall of the target formed with the cavity 12. For this, the laser beams 13 for ablation are desirably pulsed laser beams producing powerful energy for an extremely short period of time. In case where the solid target 11 is formed with a hemispherical cavity 12 having a radius of 0.1 mm, for example, extremely short pulsed laser beams 13 having a wavelength of 1 $\mu$m, a pulse width of 1 ps, pulse energy of 0.5 mJ and a peak power of 500 MW can be used. These values are merely one example. Optimum values vary depending on the target material, the radius and volume of the cavotu, the wavelength of the ablation laser beams, etc. When the laser pulse width is selected, there is also a case where it is preferably on the order of fs that is shorter or sub-ns that is longer than that in the above example.

Figure 1B:
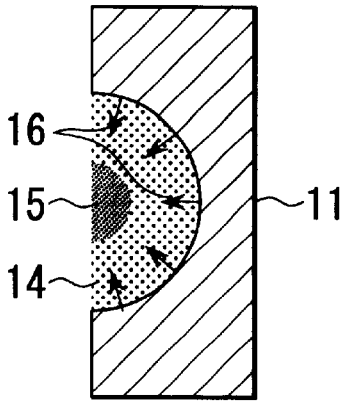

As soon as pulsed laser beams 13 for ablation have been projected, the temperature of the surface-layer substance of the inner wall of the target formed with the cavity 12 is raised to not less than the vaporization temperature of the substance and, as schematically indicated by arrows 16 in FIG. 1(B), the vaporized surface-layer substance 14 begins to expand to the vacuum side. What is important here is that in a conventional plasma light source, this stage that is merely an initial ablation step in the present invention has already contemplated generating X-rays and has therefore effected irradiation with pulsed laser beams having a much higher intensity and a much longer pulse width of around 10 ns from the standpoint of the ablation purpose in order to obtain larger X-ray energy than in the above embodiment of the present invention. For this reason, the surface substance of a solid target has heretofore been excessively ablated.

On the other hand, in the present invention, only the surface-layer of the solid target is heated to not less than the vaporization temperature to strip the minimum necessary amount of substance off the solid target and then the temperature of the solid target 11 is lowered to not more than the vaporization temperature. When the vaporized substance 14 is heated to produce a high-temperature plasma, radiation rays (hereinafter referred to simply as X-rays) are emitted from the plasma. However, when plasma heating is conducted before the vaporized substance 14 is separated sufficiently from the surface of the solid target 11, the solid target 11 per se is re-heated by heat conduction from the high-temperature plasma to produce a debris generation source. In order to prevent this, it is necessary to effect plasma heating after the ablated substance 14 has flown a sufficient distance from the wall surface of the solid target 11. This is done in the present invention.

As in the case of a conventional solid target, when a vaporized substance is a merely expanded substance from the planar wall surface of the target, the plasma density thereof is abruptly lowered. Even when such expanded substance is irradiated with heating laser beams, little energy is absorbed by the substance. On the other hand, the cavity 12 formed in the solid target 11 in the present invention produces an extremely large effect. To be specific, the vaporized substance 14 stripped off the solid target 11 moves to a specific region indicated by reference numeral 15 in FIG. 1(B) within the space of the cavity 12, the center region of the space here, owing to the lens-like effect of the cavity, to form a highly densified portion 15. This density compression effect can be obtained not only when the cavity 12 is hemispherical, but also when the cavity has a cylindrical, columnar, conical or pyramidal shape or other shape resembling any of these. In addition, the cross-sectional shape of the cavity may be a semicircle, rectangle or triangle or other linear shape resembling any of these. The minimal value of the diameter of the cavity 12 varies depending on the pulse width and pulse energy of the pulsed laser beams 13 for ablation and pulsed laser beams 17 for heating that will be described later, but is generally in the appropriate range of tens of $\mu$m to around 1 mm.

Figure 1C:
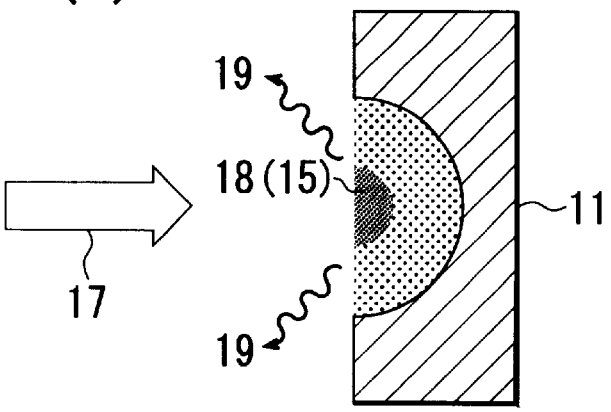
Figure 3:
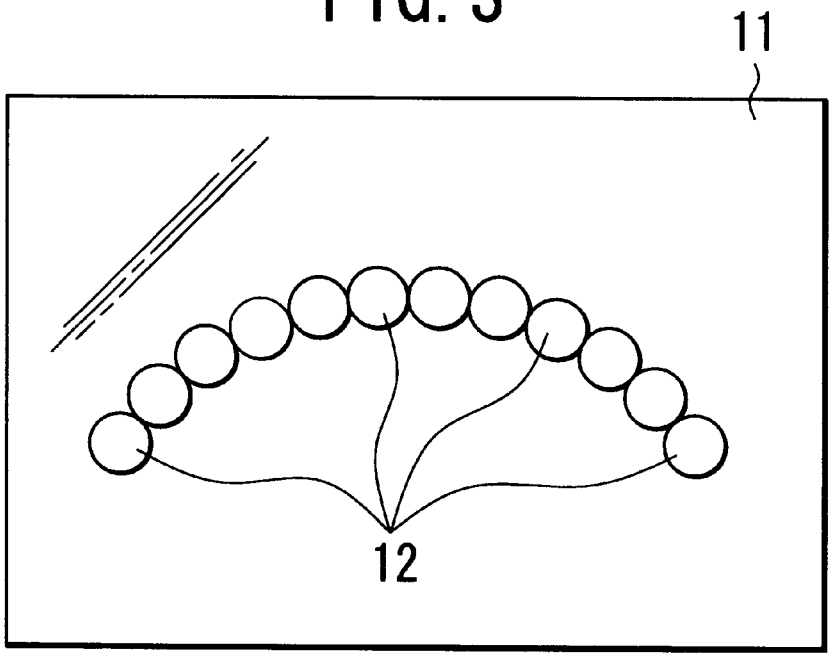
FIG. 3 is a plan view of a solid target in still another embodiment.

In the present invention, subsequent heat treatment is conducted after formation of the highly densified portion 15 produced in consequence of filling the cavity 12 with the vaporized substance 14 and increasing the density in the vicinity of the center of the cavity. In other words, a suitable time after the irradiation with the pulsed laser beams 13 for ablation, the pulsed laser beams 17 for heating are projected from a suitable heating laser source that is not shown. When the morphological parameters of the cavity 12 and the ablation pulsed laser beams 13 satisfy the various conditions mentioned above, for example, the space in the cavity 12 is substantially filled with low-temperature gas 14 whose density is lower by three orders than the solid density, as shown in FIG. 1(B),3 ns after the irradiation with the ablation pulsed laser beams 13. Ideally, this gas 14 is substantially neutral. In many cases, however, the gas is slightly ionized. Therefore, as shown in FIG. 1(C), the gas 14 is irradiated with the heating pulsed laser beams 17 having a wavelength of 1 $\mu$m a pulse width of 1 ns, pulse energy of 50 mJ and a peak power of 50 MW, for example. As a result, the highly densified portion 15 present in the space within the cavity 12 absorbs the energy of the heating pulsed laser beams 17 and is converted into a high-temperature plasma 18 of around 100 eV, from which X-rays 19 having a spectral peak at a wavelength of around 60 mn are emitted.

According to the present invention, since the high-temperature plasma 18 can thus be generated at a position sufficiently far from the inner wall of the solid target 11, the heat conduction to the solid target 11 can be suppressed to a low level. In addition, since the vaporized substance 14 is heated after being sufficiently accelerated and expanded, the plasma 18 during being heated by the heating pulsed laser beams 17 is little accelerated and energy lost as plasma kinetic energy can be suppressed. Eventually, the efficiency of conversion to X-rays is greatly enhanced. In order to obtain the same radiation quantity as in the present invention using a conventional method, input energy approximately 10 times or more that used in the present invention will be required.

The heating by the heating pulsed laser beams 17 first raises the temperature in the vicinity of the center of the space in the cavity 12. However, if the laser pulse width is unduly large, the high-temperature region spreads with the lapse of time to reach the wall surface of the solid target 11, with the result that the laser beams are absorbed in the vicinity of the wall surface of the solid target 11. This raises the temperature of the wall surface of the solid target 11 to excessively generate debris. Therefore, the pulse width of the heating pulsed laser beams 17 should not be unduly large in order to suppress the generation of debris. However, the pulse width should be varied depending on the radius and shape of the cavity 12, and it is considered that sub-ns to several ns would be the suitable range of pulse width.

Since about 3 ns is required in this embodiment to heighten the density of the ablated substance 14 that has filled the cavity 12 in the vicinity of the center of the space in the cavity, the time delay from the termination of irradiation with the ablation pulsed laser beams 13 to the initiation of irradiation with the heating pulsed laser beams 17 is set to be 3 ns. However, this is a matter of design consideration, and the optimum time delay varies depending on the radius and size of the cavity, target material, and intensities of the laser beams 13 and 17.

In the present invention, the density compression effect of the ablated substance 14 is obtained by the shape of the cavity 12 including a hemispherical shape. However, since the operation of the ablated substance is passive, the compression effect has its own limit. In order for the vaporized substance 14 to be sufficiently absorbed even if the density thereof is not so high, the wavelength of the heating pulsed laser beams 17 is preferably longer and is suitably in the range of 0.5 $\mu$m to around 1 $\mu$m shown above. On the other hand, the wavelength of the generated X-rays 19 is greatly affected by the temperature of the high-temperature plasma 18 produced by the heating step. In order to generate X-rays with a shorter wavelength, the heating step is carried out using a much higher irradiation power. The irradiation power in this embodiment is merely an example.

Figure 2:
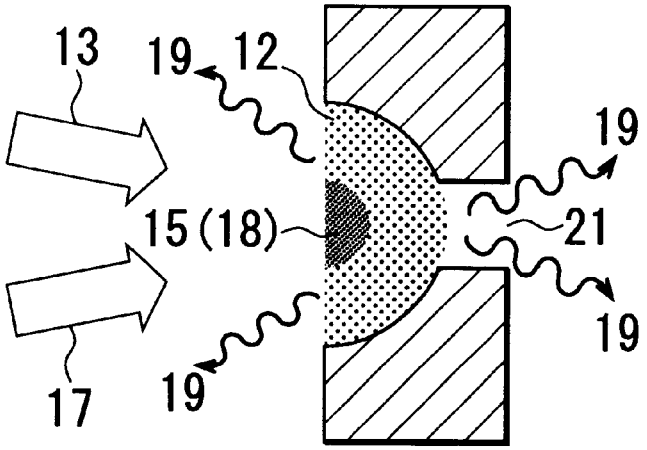
FIG. 2 is an explanatory view showing another embodiment.

FIG. 2 shows another embodiment of the present invention. The description given above with reference to FIGS. 1(A), 1(B) and 1(C) includes concepts that also apply to the embodiments shown in FIG. 2 et seq. These are omitted from the following description and only the characterizing part of each embodiment will be described. In the embodiment of FIG. 2, a through hole 21 communicating with the cavity 12 formed in the solid target 11 is bored in the solid target 11. Although two kinds of laser beams are shown together in FIG. 2 for the sake of simplicity, a substance is ablated using the ablation pulsed laser beams 13 and, a suitable time after, irradiation with the heating pulsed laser beams 17 is conducted to produce a high-temperature plasma 18. Of the X-rays emitted from the plasma, those passing through the through hole 21 can be utilized. This is advantageous in the following aspects.

The ablation pulsed laser beams 13 and the heating pulsed laser beams 17 produced by light sources of this kind are converged by a suitable lens or other such means that is not shown, and then projected. For this reason, when the X-rays 19 emitted from the high-temperature plasma 18 are to be obtained from the side on which the laser beams are projected, the angle at which the X-rays can be utilized is greatly restricted. On the other hand, if the X-rays passing through the through hole 21 formed in the solid target 11 and exiting to the side opposite the beam projecting side as illustrated in the embodiment of FIG. 2 are utilized, all restrictions imposed in the presence of the physical system for laser irradiation can be lifted. Furthermore, since debris are scattered mainly to the laser projecting side, utilization of the X-rays on the opposite side can attain greater reduction of debris.

The position at which the through hole 21 is to be bored is, of course, optional. Although the through hole 21 in the drawing pierces through the solid target at the deepest point of the hemispherical cavity 12, it is not necessarily required to open to the center of the cavity 12. It may be formed so as to pierce through the side surface of the solid target 11. The number of such through holes can be optionally selected.

FIG. 3 shows still another embodiment of the present invention different in a viewpoint from the above embodiment. The solid target 11 in this embodiment is formed with a plurality of cavities 12. The plurality of cavities 12 are arranged along a circular arc having suitable curvature. When this solid target 11 is used, given X-rays can be generated by deflecting and projecting one or plural shots of the ablation pulsed laser beams 13 and heating pulsed laser beams 17, in order, to every cavity 12. Arranging the plurality of cavities 12 along a circular arc enables illumination, which is required for illumination of small aberration in reduction lithography. However, since the cavities are arranged at intervals and X-rays are generated only in the vicinity of the center of each cavity 12, distribution of X-ray intensities is not strictly uniform along the circular arc. X-rays having intensity distribution uniform along the circular arc can be obtained by continuously rotating the entire target along the circular arc. The method of obtaining X-rays having uniform intensity distribution is applicable not only to the case of the arcuate arrangement of cavities, but also to the cases of linear arrangement and curved arrangement in an optional shape.

As described in the foregoing, the present invention is directed to an improvement in the structure of the solid target 11 and an improvement in the procedures of ablating and heating treatment. The present invention further encompasses a different aspect; specifically it encompasses the idea that debris per se can be effectively utilized depending on manner of use. As described herein above, radiation rays from this kind of light source are generally subjected to utilization via an optical system including a multilayer reflecting mirror, for example. An X-ray multilayer mirror, for example, is generally composed of a plurality of light element (Si, for example) layers and a plurality of heavy element (Mo, for example) layers that are alternately stacked up regularly.

In view of the above, two solid targets 11 made of two materials (Si and Mo, for example) for such multilayers are prepared and interchanged every one constant number of shots or predetermined period of time to deposit a multilayer, using the ablated substance, on a suitable support base (not shown) disposed in the vicinity of the target Without necessarily using a plurality of materials, there can be adopted a method that comprises the steps of using Mo as a plasma light source target material, removing a multilayer reflecting mirror on which Mo is deposited after a constant number of shots or a predetermined period of time, coating the mirror with Si by the use of a separate sputtering device, using the resultant mirror as the plasma light source converging mirror again, and repeating these steps.

Depending on their flight speed, the particles emitted from plasma have a sputtering function by which they ablate the multilayer without being deposited thereon. The multilayer used under this condition will change slightly in reflectance and experience a gradual reduction in its number of layers. Since undue reduction of the number of layers reduces the reflectance of the multilayer, it is necessary to remove the reflecting mirror before reduction of the reflectance and then deposit layers on the mirror.

The means mentioned above can perfectly solve the problem of debris and enable debris to be effectively utilized. The target materials are not limited to Mo and Si, but include W, C and other materials usable in this field. More than two kinds of target materials can also be used. When the size of the hemispherical cavity 12 of the target 11 is required to be relatively large, e.g. not less than 500 μm in diameter, the cavity is generally formed by machining. If a relatively small hemispherical cavity, e.g. not more than 100 μm in diameter, should suffice, it can be formed by laser processing. In the latter case, it is possible to prepare separate energy laser beams for laser processing or adjust the pulse width and so on of the ablation or heating laser beams, if necessary, and use the adjusted laser beams as those for laser processing.

Industrial Applicability:

The present invention proves a boon to solid target system plasma light sources obtaining radiation rays troubled by the single problem of debris generation and can provide an excellent solid target system plasma light source superior to plasma light sources of other systems.

What is claimed is:

1. A laser plasma light source for generating radiation rays from plasma obtained by irradiating a solid target with laser beams, comprising:

a cavity formed in a portion of the solid target at which the laser beams are projected;

an ablation laser source for projecting the laser beams (13) toward said portion to vaporize a surface-layer substance of said portion and form a highly densified portion of the vaporized substance at a specific region within said cavity; and a heating laser source for projecting heating laser beams onto the highly densified portion to form a high-temperature plasma.

2. The laser plasma light source according to claim 1, characterized in that either or both of said ablation laser beams and said heating laser beams are pulsed laser beams.

3. The laser plasma light source according to claim 1, characterized in that the solid target is formed with a trough hole that communicates with said cavity.

4. The laser plasma light source according to claim 1, characterized in that said cavity comprises a plurality of cavities.

5. The laser plasma light source according to claim 4, characterized in that said plurality of cavities are arranged along a locus of predetermined shape.

6. The laser plasma light source according to any one of claims claim 1, characterized in that the solid target comprises a plurality of solid targets made of different materials.

7. A method for generating radiation rays using a laser plasma light source provided with a solid target, characterized by the steps of:

providing the solid target with a cavity;

projecting ablation laser beams toward said cavity to vaporize a surface-layer substance of the solid target at said cavity;

leaving a vaporized substance standing until it is compressed within the cavity; and projecting heating laser beams onto the compressed substance to form a high-temperature plasma, thereby generating radiation rays.

8. The method for generating radiation rays according to claim 7, characterized in that either or both of said ablation laser beams and said heating laser beams are pulsed laser beams.

9. The method for generating radiation rays according to claim 7, characterized in that said cavity comprises a plurality of cavities each irradiated with said ablation laser beams and said heating laser beams in order.

10. The method for generating radiation rays according to claim 9, characterized in that said plurality of cavities are irradiated with said ablation laser beams and said heating laser beam in order by moving the solid target.

11. The method for generating radiation rays according to claim 7, characterized in that the solid target is formed with a through hole that communicates with said cavity, and radiation rays passing through said through hole are utilized.

12. The method for generating radiation rays according to claim 7, characterized in that a support base is disposed in the vicinity of the solid target depending on a kind of said vaporized substance from said cavity of the solid target, and layers of said vaporized substance are deposited on said support base.

13. The method for generating radiation rays according to claims 7, characterized by the steps of:

using a plurality of solid targets made of two or more different materials in place of the solid target;

interchanging said plurality of solid targets every constant number of laser shots or predetermined period of time;

disposing a support base in the vicinity of said plurality of solid targets depending on kinds of said two or more materials ablated by said ablation laser beams; and depositing and forming a multilayer of said two or more different materials on said support base.

14. The method for generating radiation rays according to claim 7, characterized by the steps of disposing a support base in the vicinity of the solid target depending on said substance vaporized from said cavity of the solid target by the projection of said ablation laser beams to form a layer on said support base, and sputtering said layer.

* * * * *